United States Patent [19]

Donaldson et al.

[11] Patent Number: 4,639,643

[45] Date of Patent: Jan. 27, 1987

[54] THYRATRON INTERRUPTERS

[75] Inventors: Timothy P. Donaldson, Great Totham; Hugh Menown, Writtle, both of England

[73] Assignee: English Electric Valve Company Limited, Chelmsford, England

[21] Appl. No.: 320,682

[22] Filed: Nov. 12, 1981

[30] Foreign Application Priority Data

Nov. 15, 1980 [GB] United Kingdom ..... 8036736

[51] Int. Cl.[4] ..... H05B 37/00; H05B 39/00; H05B 41/00; H01J 11/04; H01J 13/48; H01J 15/04; H01J 17/36

[52] U.S. Cl. ..... 315/344; 315/339

[58] Field of Search ..... 315/339, 340, 344, 357; 313/146, 153, 156, 157, 158, 159; 314/20, 44, 51, 54, 112; 361/58

[56] References Cited

U.S. PATENT DOCUMENTS 3,636,407 1/1972 Baker ..... 313/156

FOREIGN PATENT DOCUMENTS 1257939 7/1969 United Kingdom .
1494051 7/1975 United Kingdom .

*Primary Examiner*—William L. Sikes
*Assistant Examiner*—Robert E. Wise
*Attorney, Agent, or Firm*—Spencer & Frank

[57] ABSTRACT

A magnetic thyratron interrupter is provided having between an anode and a cathode a structure having an aperture therein for a discharge presenting a succession of surfaces in the direction of discharge which are contacted when the discharge is moved by applying a magnetic field transversely to the discharge direction. Examples of structure are stacks of discs having concentric holes which are alternately of larger and smaller diameter and a strip of gauze wound into a spiral.

19 Claims, 4 Drawing Figures

THYRATRON INTERRUPTERS

BACKGROUND OF THE INVENTION

This invention relates to thyratron interrupters.

As is well known, when a discharge current flows between the anode and cathode of a thyratron a magnetic field applied transversely to the direction of discharge couples with the discharge current thereof in such a way as to move the discharge in a direction mutually orthogonal to the direction of the discharge current and the magnetic field. A thyratron interrupter has already been proposed, as described in the specification of our prior U.K. Pat. No. 1494051, in which this effect is utilised to control the discharge in such a manner that it either passes through the aperture of an apertured electrode or strikes the electrode.

SUMMARY OF THE INVENTION

One object of the present invention is to provide an improved thyratron interrupter in which the quenching effect achieved is improved relative to that achieved by the use of a simple apertured electrode.

According to this invention, a thyratron interrupter is provided having between an anode electrode and a cathode electrode a structure having a passage therethrough for discharge current, said structure presenting, outside of the normal discharge path, a succession of surfaces in the direction of discharge such that if during operation the discharge is moved into contact therewith ions and electrons in said discharge tend to recombine to extinguish said discharge.

Normally electro-magnetic means will be provided to control the path of said discharge. Such electro-magnetic means need not form part of the thyratron tube as manufactured and sold of course. The electro-magnetic means may be arranged such as to cause the discharge to move into contact with said structure when de-energised but preferably said electro-magnetic means is arranged such as to cause said discharge to move into contact with said structure when energised or when the energy applied thereto is increased.

Normally said structure is provided to float in potential in operation and no external connection is provided thereto.

Preferably said structure comprises a set of discs stacked in the direction of discharge and having concentric holes forming said passage, which holes are of different diameters one to another so as to provide said succession of surfaces.

Preferably said holes are alternately of larger and smaller diameter.

A further structure may be provided within said passage whereby said passage is annular in cross section transverse to the direction of discharge in which case said further structure preferably comprises a stack of circular plates which are alternately of larger and smaller outside diameters.

Preferably where, as known per se, a control grid is provided between said anode electrode and said structure which control grid has an annular aperture therein, preferably the greatest diameter of the passage through said structure is of the same order of magnitude as the diameter of the annular aperture in said control grid.

In another example of the invention, said structure is formed of a set of discs stacked in the direction of discharge and having overlapping slots forming said passage which slots are of different dimensions, and preferably alternately larger and smaller, one to another.

Said discs may be of electrically conductive material or electrically insulating material or a combination of both.

In another example of the invention, said structure is formed of a strip of gauze, of conductive or insulating material, wound around in a spiral.

In another example of the invention, said structure is formed of a sheet of gauze, of conductive or insulating material, coiled to form a number of turns around an aperture forming a passage for said discharge current.

To accommodate said structure, the envelope of said thyratron may be enlarged in the region thereof.

Said thyratron may be arranged in the form of a multigap thyratron, a series of combinations each of a discharge quenching structure and an anode electrode structure being arranged between a cathode and a final anode electrode.

Said thyratron interrupter may also be of a type in which said anode is arranged also to act at times as a cathode e.g. a double cathode thyratron.

BRIEF DESCRIPTION OF THE DRAWINGS

The invention is illustrated in and further described with reference to the accompanying drawings in which.

DETAILED DESCRIPTION OF THE PREFERRED EMBODIMENTS

Figure 1:
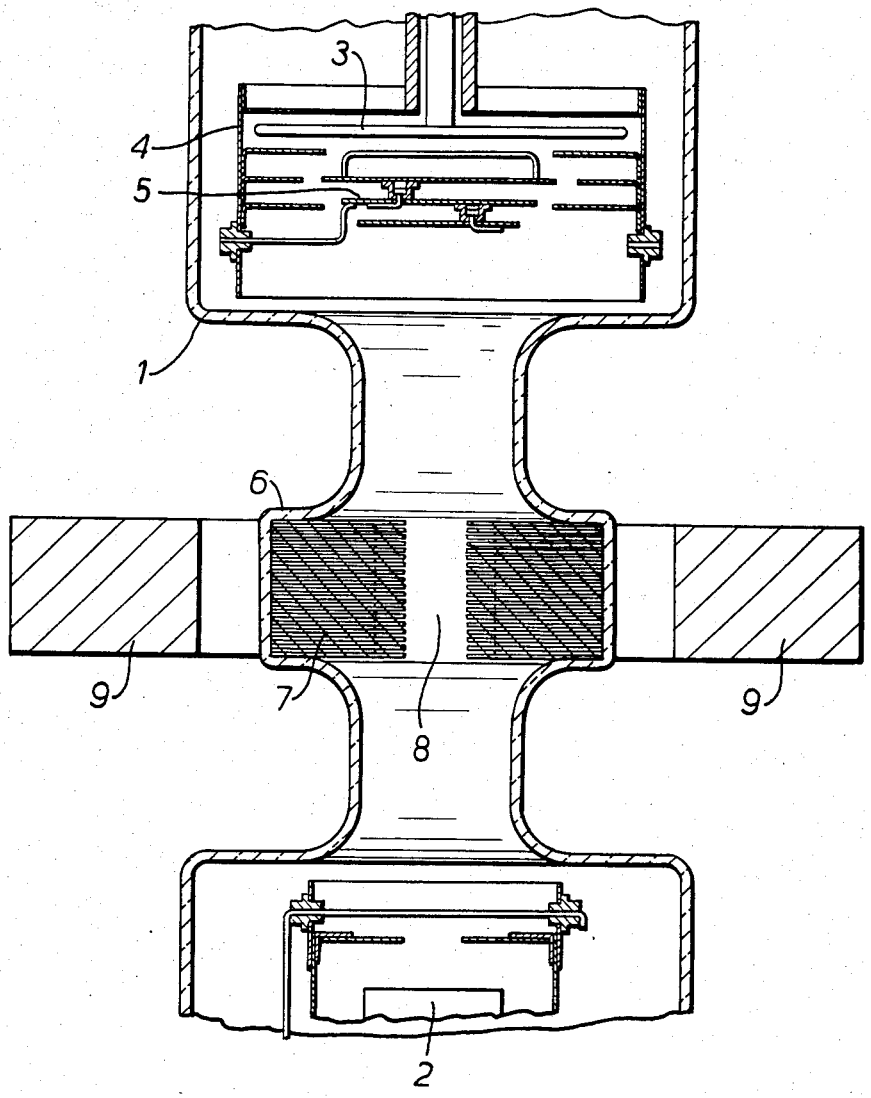
FIG. 1 is a section through the length of a thyratron interrupter in accordance with the present invention.

Referring to FIG. 1, the thyratron interrupter consists of a glass or ceramic envelope 1 having at one end a cathode 2 and at its other end an anode electrode 3. The anode electrode 3 is mounted within a so-called anode box 4 which shields the anode and control grid 5 which is also mounted within the box 4. The anode box 4 is arranged to operate at cathode potential. Between the anode structure and the cathode 2, and accommodated in an enlarged portion 6 of the envelope 1, is a quenching structure 7. The quenching structure consists of a set of apertured discs stacked one upon another in the direction of discharge. The discs have concentric round holes therein which together form a passage 8 for the discharge during normal operation. The holes forming passage 8 in the discs are sufficiently large so that the structure 7 does not interfere with the normal discharge. The holes are also alternately of larger and smaller diameter so that a labyrinth structure is formed exhibiting a succession of surfaces in the direction of discharge. In this example the discs forming structure 7 are of conductive metal but no external connection is made thereto and the potential of the structure 7 is permitted to float during operation.

Outside of the envelope 1 and adjacent the structure 7 is a magnetic solenoid arrangement represented schematically at 9. The solenoid arrangement 9 is such that when energised it provides a magnetic field which is transverse to the discharge so that it couples with the discharge current in such a way as to move the discharge orthogonally with respect to the directions of the discharge current and the magnetic field so that the discharge contacts the succession of surfaces provided by the structure 7. On these surfaces ions and electrons in the discharge are combined and the discharge is extinguished.

In the particular example being described, the holes forming the passage 8 are round holes. In another example of the invention the holes forming passage 8 are in the form of slots which are alternately larger and smaller.

Figure 2:
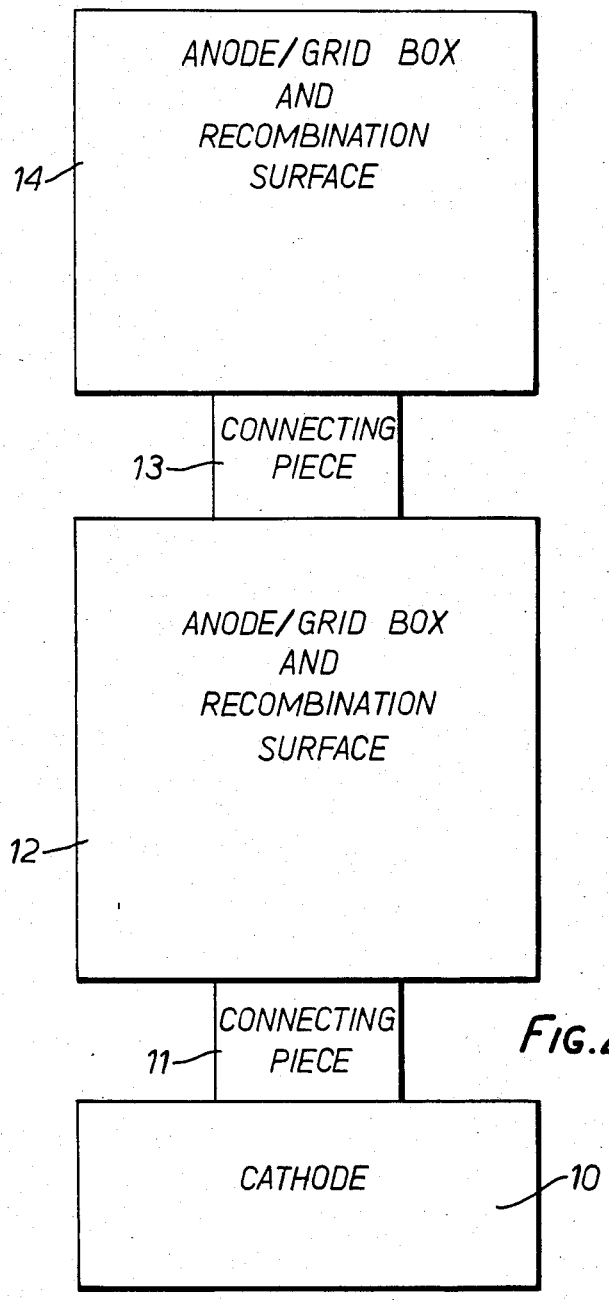
FIG. 2 is a block schematic diagram illustrating a further development of the thyratron interrupter illustrated in FIG. 1.

Referring to FIG. 2 this illustrates the nature of a multigap thyratron interrupter developed from the structure illustrated in FIG. 1. The multigap thyratron interrupter consists of a cathode arrangement 10 which is essentially similar to the cathode arrangement 2 in FIG. 1. The cathode arrangement 10 is connected via a connecting piece 11 to a module 12 which consists of the combination of a structure such as 7 in FIG. 1 and an anode/grid box arrangement corresponding to the structure formed of 3, 4, and 5 in FIG. 1.

Module 12 is connected via a further connecting piece 13 to a second module again essentially similar to module 12. Further modules like module 12 and 13 may be stacked one upon another as required, the anode in the final module being the final anode of the multigap thyratron interrupter thus formed.

Figure 3:
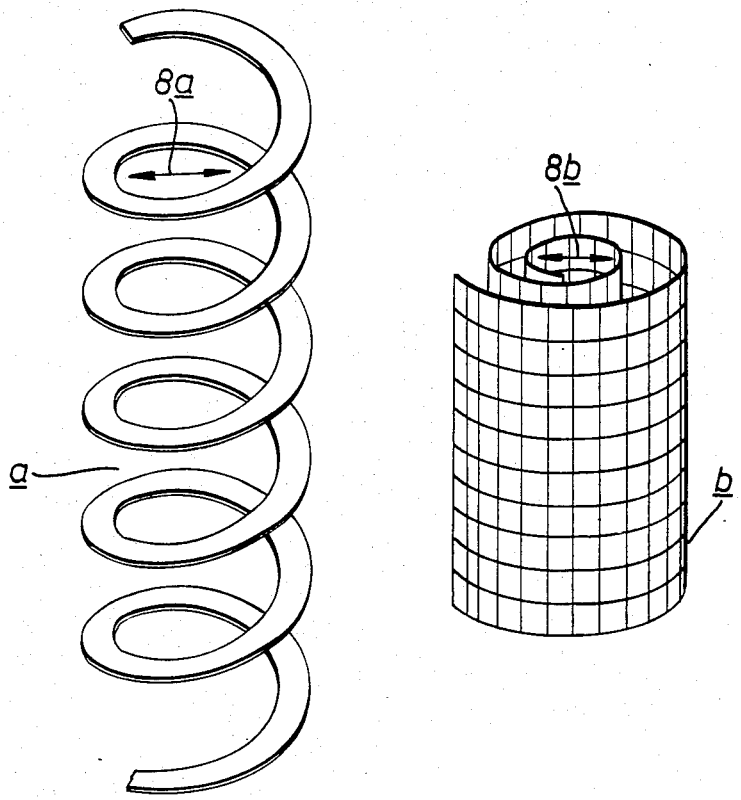
FIG. 3 illustrates other forms of quenching structure which may be used in a thyratron interrupter in accordance with the present invention.

Referring to FIG. 3 this illustrates at (a) and (b) other forms of quenching structures which may replace the structure 7 in FIG. 1. In the case of (a) the quenching structure is formed of a strip of conductive gauze wound into a flat spiral the central aperture 8*a* of which forms the passage corresponding to passage 8 in FIG. 1, for the discharge during normal operation. In the case of (b) the structure consists of a sheet of conductive gauze coiled to form a number of turns surrounding a central aperture 8*b* corresponding to passage 8 in FIG. 1 for the discharge current during normal operation.

Figure 4:
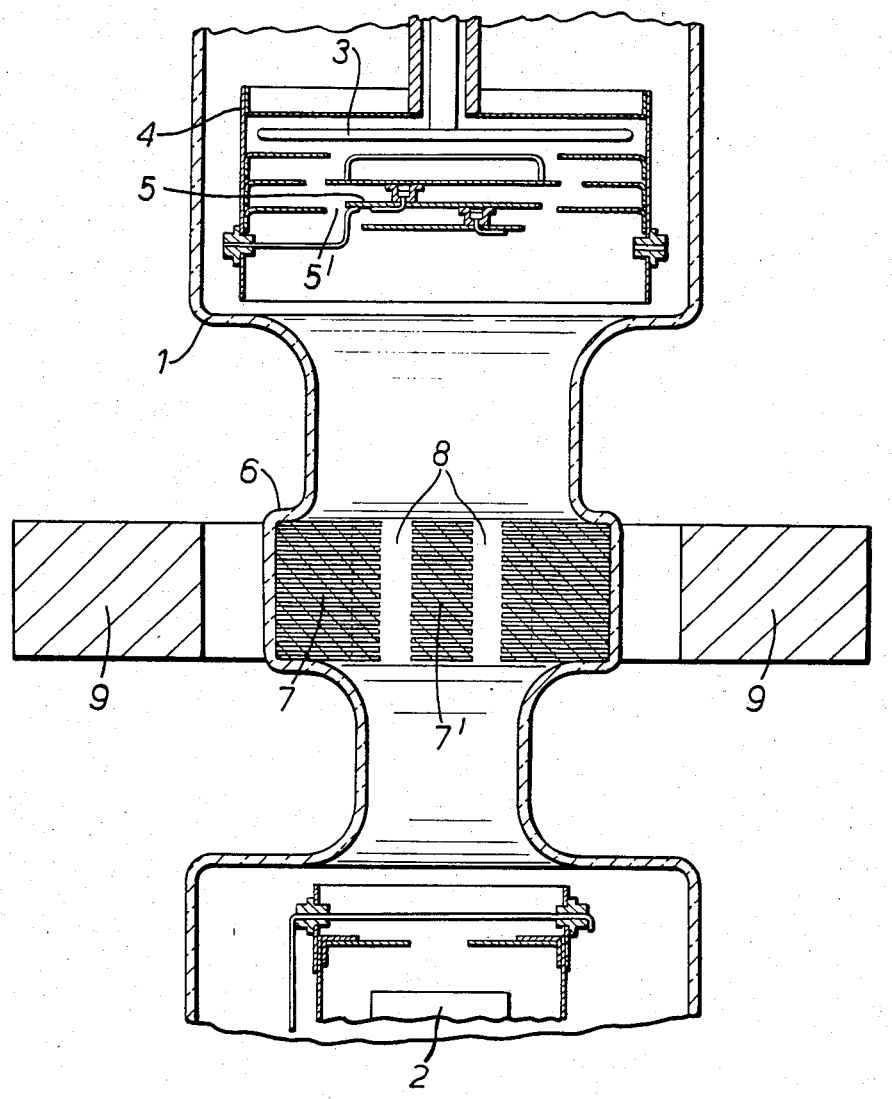
FIG. 4 illustrates a modification of the thyratron interrupter illustrated in FIG. 1.

Referring to FIG. 4 the thyratron interrupter illustrated therein is in most respects similar to that illustrated in FIG. 1 and like references are used for like parts. The essential difference resides in the nature of the quenching structure 7. In FIG. 4 the quenching structure 7 has a passage 8 therein which is of greater diameter than that in FIG. 1 and accommodates a further quenching structure 7′ which is formed of a stack of circular plates which are alternately of larger and smaller outside diameters so that in cross section the passage 8 becomes an annulus. Whilst, as with the passage 8 in FIG. 1, the greatest diameter of the passage 8 in FIG. 4 is not critical this is of the same order of magnitude as that of annular aperture 5′ in the control grid structure 5.

With the arrangement shown in FIG. 4, the discharge is itself of annular cross section as it passes through the quenching structure 7 and when deflected by the solenoid arrangement 9 the discharge contacts not only the inner surfaces of the aperture discs forming structure 7, but also the outer surfaces of the circular plates forming structure 7′.

We claim:

1. A thyratron interruptor comprising: discharge means for generating a discharge current comprising an anode electrode, a control grid and a cathode electrode, said discharge means having a space between said anode and cathode electrodes for the discharge current to flow with said control grid being disposed in said space; and quenching means for selectively causing the recombination of ions and electrons in the discharge to quench the discharge, said quenching means comprising a quenching structure which is disposed in said space between said anode and cathode electrodes in addition to said control grid, with said structure including plural surfaces, whose potential may float during normal operation, disposed along the direction of the discharge current flow and presenting a passage therethrough for the discharge current flow, and control means for selectively moving the discharge current flow into contact with said plural surfaces to cause the recombination of ions and electrons in the discharge.

2. An interrupter as claimed in claim 1 and wherein said control means comprises electro-magnetic means provided to control the path of said discharge.

3. An interrupter as claimed in claim 2 wherein said electro-magnetic means is arranged such as to cause said discharge to move into contact with said structure when energised or when the energy applied thereto is increased.

4. An interrupter as claimed in claim 1 wherein no external electrical connection to said structure is provided.

5. An interrupter as claimed in claim 1 wherein said structure comprises a set of discs stacked in the direction of discharge and having concentric holes forming said passage, which holes are of different diameters one to another so as to provide said succession of surfaces.

6. An interrupter as claimed in claim 5 wherein said holes are alternately of larger and smaller diameter.

7. An interrupter as claimed in claim 5 or 6 wherein a further structure is provided within said passage whereby said passage is annular in cross section transverse to the direction of discharge.

8. An interrupter as claimed in claim 7 wherein said further structure comprises a stack of circular plates which are alternately of larger and smaller outside diameters.

9. An interrupter as claimed in claim 8 wherein said control grid is provided between said anode electrode and said structure wherein said control grid has an annular aperture therein, and wherein the greatest diameter of said passage through said structure is of the same order of magnitude as the diameter of said annular aperture in said control grid.

10. An interrupter as claimed in claim 5 wherein said discs are of electrically conductive material.

11. An interrupter as claimed in claim 5 wherein said discs are of electrically insulating material.

12. An interrupter as claimed in claim 5 wherein said discs are a combination of electrically conductive and electrically insulating material.

13. An interrupter as claimed in claim 1 and wherein said structure is formed of a set of discs stacked in the direction of discharge, and having overlapping slots forming said passage which slots are of different dimensions one to another.

14. An interrupter as claimed in claim 13 wherein said slots are alternately larger and smaller.

15. An interrupter as claimed in claim 1 wherein said structure is formed of a strip of gauze, of conductive or insulating material, wound around in a spiral.

16. An interrupter as claimed in claim 1 wherein said structure comprises a sheet of gauze, of conductive or insulating material, coiled to form a number of turns around an aperture forming said passage for said discharge current.

17. An interrupter as claimed in claim 1 wherein to accommodate said structure, the envelope of said tnyratron is enlarged in the region of said structure.

18. A multigap thyratron interrupter and comprising a series of combinations each of a discharge quenching structure as defined in claim 1 and an anode electrode structure arranged between a cathode electrode and a final anode electrode.

19. A thyratron interrupter as claimed in claim 1 or 18 and wherein said anode or final anode is arranged also to act at times as a cathode.

* * * * *